US006296002B1

(12) United States Patent
Tashchyan

(10) Patent No.: US 6,296,002 B1
(45) Date of Patent: Oct. 2, 2001

(54) LIGHTWEIGHT COLLAPSIBLE ENCLOSURE

(76) Inventor: Minas Tashchyan, 2172 E. 7180 S., Salt Lake City, UT (US) 84121

( * ) Notice: Subject to any disclaimer, the term of this patent is extended or adjusted under 35 U.S.C. 154(b) by 0 days.

(21) Appl. No.: 09/528,920

(22) Filed: Mar. 20, 2000

(51) Int. Cl.[7] ..... F04H 15/04

(52) U.S. Cl. ..... 135/96; 135/90; 135/115; 135/117; 135/119; 297/184.1

(58) Field of Search ..... 135/87, 90, 96, 135/97, 115, 119, 120.1, 120.3, 161, 20.1; 297/184.15, 184.1, 188.05

(56) References Cited

U.S. PATENT DOCUMENTS

| | | | | |
|---|---|---|---|---|
| 3,935,874 | | 2/1976 | Cohen . | |
| 4,641,883 | | 2/1987 | Kato . | |
| 4,809,724 | | 3/1989 | Fuser . | |
| 4,871,141 | | 10/1989 | Chen . | |
| 4,915,120 | * | 4/1990 | Zilokowski | 135/90 |
| 4,924,896 | | 5/1990 | Carter . | |
| 5,110,184 | | 5/1992 | Stein et al. . | |
| 5,168,889 | * | 12/1992 | Diestel | 135/88.01 |
| 5,203,363 | * | 4/1993 | Kidwell | 135/90 |
| 5,255,954 | | 10/1993 | Rogers . | |
| 5,350,215 | | 9/1994 | DeMars . | |
| 5,588,695 | | 12/1996 | Gomes . | |
| 5,695,100 | * | 12/1997 | O'Brien | 135/96 |
| 5,890,507 | * | 4/1999 | Hinsperger | 135/96 |

* cited by examiner

*Primary Examiner*—Beth A. Stephan
(74) *Attorney, Agent, or Firm*—Kirton & McConkie

(57) ABSTRACT

The present invention is directed to a lightweight collapsible enclosure. The enclosure is adapted to attach to or about a folding chair. The enclosure provides vertical and lateral spans about and above the folding chair. A canopy is disposed over the spans to create an enclosure. The enclosure is readily collapsible with a folding chair.

5 Claims, 3 Drawing Sheets

LIGHTWEIGHT COLLAPSIBLE ENCLOSURE

BACKGROUND

1. The Field of the Invention

The present invention is directed to a lightweight collapsible enclosure. In particular, it is directed to an enclosure capable of being attached to a collapsible folding chair and providing an enclosure about multiple sides of the chair.

2. The Background Art

A number of attempts have been made to provide the user of a chair at least some protection from weather and the elements, such as sun, wind, rain, or snow. Such devices have included umbrellas, adjustable umbrellas, one or more movable panels for shields attached to a chair, warming huts used by ice fishermen, and various canopies or drapes used by sportsmen.

The known prior art suffer from several disadvantages, such as limited shelter about the user to protect from sun, wind, rain, or snow. Many of the devices lack practical portability because they are either heavy in weight or bulky in size and thereby require considerable time and energy to transport and/or erect. What is needed is a lightweight collapsible enclosure or cover that is easily transported and readily adaptable to a folding chair. Such a device would provide a place of shelter or protection at the beach, for spectators of various sports, or participants of sports such as ice fishing, and even a camouflage covering for hunters. What is needed is a shelter or multi-sided enclosure which is sufficiently rigid to withstand sun, wind, rain, or snow, but which unlike the known prior art multi-sided shelters, may be erected and put in place in a matter of seconds without the need of any tools, equipment, rope, stakes, or any other equipment to secure vertical or horizontal members of the enclosure. What is needed is a lightweight collapsible enclosure whose manufacture is cheap and inexpensive and whose structure is simple and requires little or no assembly on site.

BRIEF SUMMARY AND OBJECTS OF THE INVENTION

The present invention is directed to a lightweight collapsible enclosure capable of being attached to a folding chair such that when the chair is folded, the enclosure collapses with the chair. The enclosure is constructed of lightweight poles that can be attached to or inserted into tubular elements of a folding chairs to support a multi-sided readily collapsible enclosure to provide the user shelter from sun, wind, rain, and snow. The enclosure can be made of virtually any available material depending on its intended function.

A lightweight collapsible enclosure of the present invention comprises one or more support members, each having one or more lateral members to support a surrounding and/or an overhead enclosure. The vertical support members being insertable into tubular structures of a folding chair or readily attachable thereto such that at least a portion of the foldable collapsible enclosure can be left attached to the folding chair when it is folded.

It is an object of the present invention to provide a lightweight, collapsible enclosure.

Another object of the present invention to provide a collapsible enclosure readily attachable to a folding chair.

Another object of the present invention to provide a collapsible enclosure, which can be erected without tools.

Another object of the present invention to provide a collapsible enclosure, which can be erected in seconds.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 4, is not intended to limit the scope of the invention, as claimed, but is merely representative of the presently preferred embodiments of the invention.

The presently preferred embodiments of the invention will be best understood by reference to the drawings, wherein like parts are designated by like numerals throughout.

Figure 1:
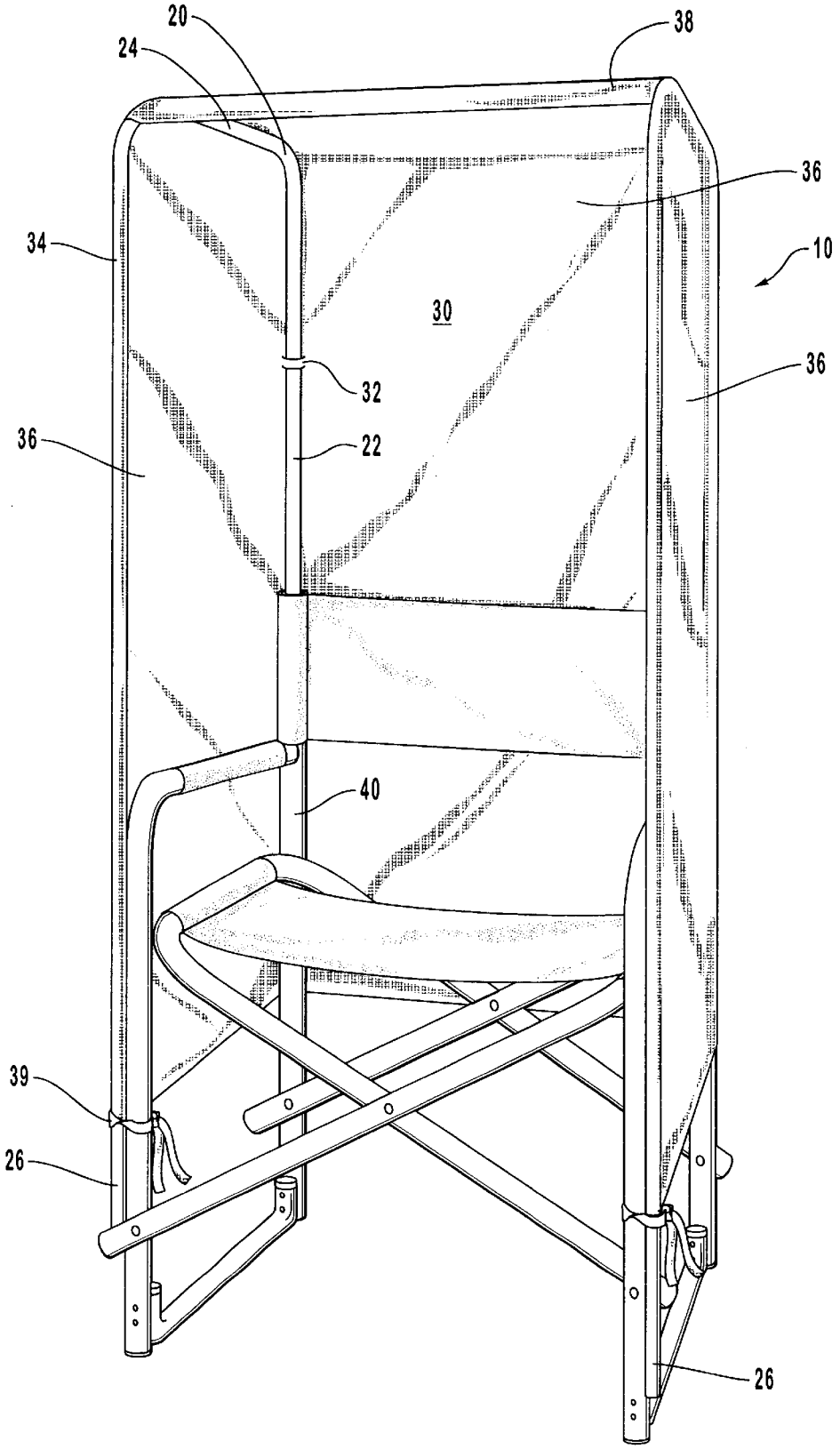
FIG. 1 is a perspective view of one embodiment of the foldable collapsible enclosure of the present invention.

FIG. 1 illustrates a preferred embodiment of the lightweight collapsible enclosure 10. Enclosure 10 defines a multi-sided enclosure or shield to protect the user from sun, wind, rain, snow, or any other element, and can be used to provide a camouflage hut or shelter.

Figure 3:
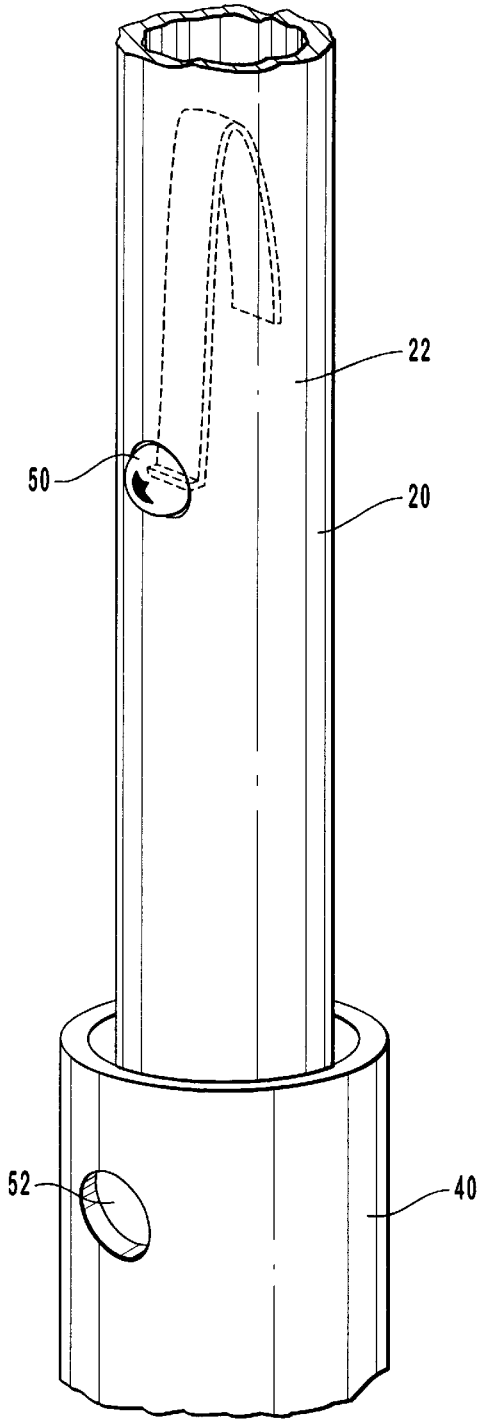
FIG. 3 illustrates one embodiment of a means for attaching a vertical support member of the present invention to the tubular structure of a known folding chair.
Figure 4:
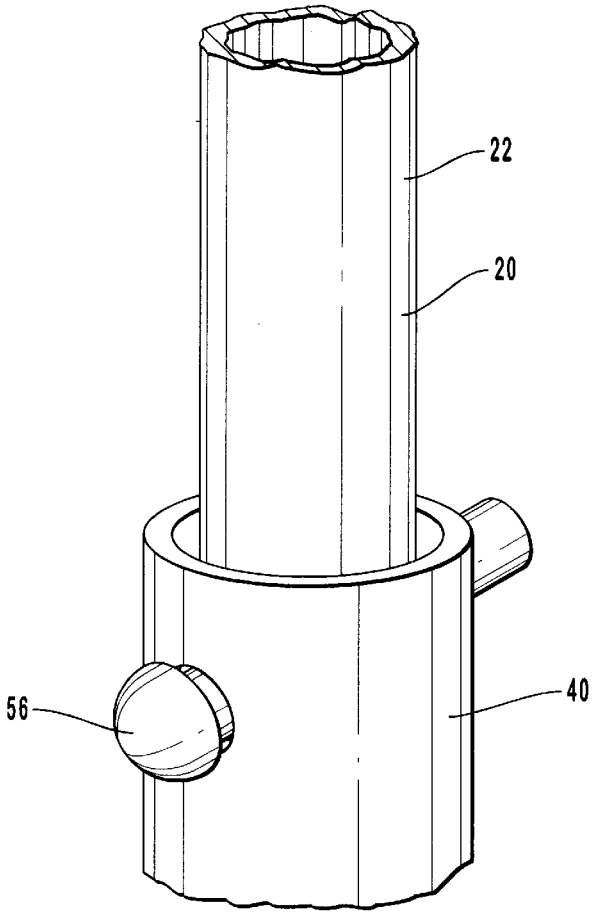
FIG. 4 is an alternative illustration of a means for attaching a vertical support member of the present invention to a tubular member of a folding chair.

Enclosure 10 comprises one or more vertical support members 20. Vertical support member 20 provides vertical height to enclosure 10 for covered head room for the user. In the preferred embodiment shown in FIG. 1, support member 20 is an inverted U-shaped body comprising a first vertical portion 22, a lateral portion 24 and a second vertical portion 26. Support member 20 is preferably made of lightweight tubular construction. First vertical member 22 is preferably of a tubular construction whose outside dimensions are smaller than and compatible with the inside dimensions of the tubular construction 40 of the folding chair, as shown in FIGS. 3 and 4. In this way, the vertical support member may be readily inserted into the opening defined by tubular structure 40 of the folding chair. If desired, means for securing the vertical support member 20 inside the tubular construction of the chair 40 are contemplated as shown in FIGS. 3 and 4. One embodiment shown in FIG. 3 provides a spring biased button 50 disposed inside vertical member 20 with the button extending through the side wall of member 20 such that the button can be depressed. Such devices are well-known. A corresponding hole 52 in the tubular construction of the chair 40 would receive button 50 when member 22 is inserted into tube 40 thereby releasably defining the relationship between vertical member 22 and tubular construction 40. An alternative embodiment is shown in FIG. 4 with a conventional pin 56 extending through both tubular construction 40 and member 22.

Vertical support member 20 also comprises a lateral portion 24 to provide a lateral span. In the preferred embodiment, support member 20 also comprises a downwardly extending portion 26. The preferred embodiment does not contemplate that downwardly extending member 26 is inserted into or attached to the folding chair, but it could be if desired. When erected, the enclosure of the present invention provides a vertical frame defining both vertical and lateral spans to support the desired canopy.

Member 20 may be manufactured from a variety of materials, such as aluminum, aluminum alloys, or any other lightweight metals. In addition, member 20 could be made of plastics such as PVC or other sufficiently strong plastics. In the preferred embodiment, a rust free material is contemplated.

The enclosure of the present invention further comprises a canopy 30. Canopy 30 comprises one or more vertical members 36 and an overhead member 38. Not shown but also contemplated is a draped portion, which could actually hang down in front of the seated user as far as desired and even including one or more observation holes or windows. Similarly, side wall or back wall members 36 could include peephole/observation holes or transparent windows as desired (not shown).

Canopy 30 is supported by one or more support members 20 thereby spanning and enclosing the foldable chair 40. Canopy 30 is disposed about support member 20 by eyelets 32 and/or sleeves 34 through which support member 20 passes. In this way, canopy 30 is readily and easily constructed of lightweight material suited for its intended purpose, readily and easily sewn to size and shape and to accommodate the insertion of one or more support members 20. Canopy 30 may also include one or more ties 39 used to releasably secure the enclosure to a portion of the folding chair.

Canopy 30 may be constructed of any desirable material or fabric depending upon the use. If the use is for protection from the sun, it may be made of any desirable lightweight material. If canopy 30 is intended to shelter from wind, then canopy 30 should comprise a material having adequate windbreak characteristics and preferably maintaining lightweight and readily foldable characteristics. Similarly, if canopy 30 is intended to shelter from rain or show, canopy 30 should be of a material sufficiently rain or waterproof. If canopy 30 is intended as a camouflage covering, canopy 30 can be constructed of any desirable camouflage material compatible with the present invention. Still further, if the present invention were to be used by outdoor workers, such as construction or road crew workers, the canopy enclosure could be made of a material of such a bright color to enhance safety and visibility as needed. A flagman could, for example, have such a enclosure made out of a hazard yellow or orange to enhance visibility and safety.

One embodiment built by the applicant utilized electrical conduit to construct member 20 and a lightweight nylon material for the canopy. The resulting enclosure weighed only about 5 pounds (5 lbs.) and provided excellent protection from sun, wind, rain and snow. Equivalents thereto are contemplated by this patent.

Figure 2:
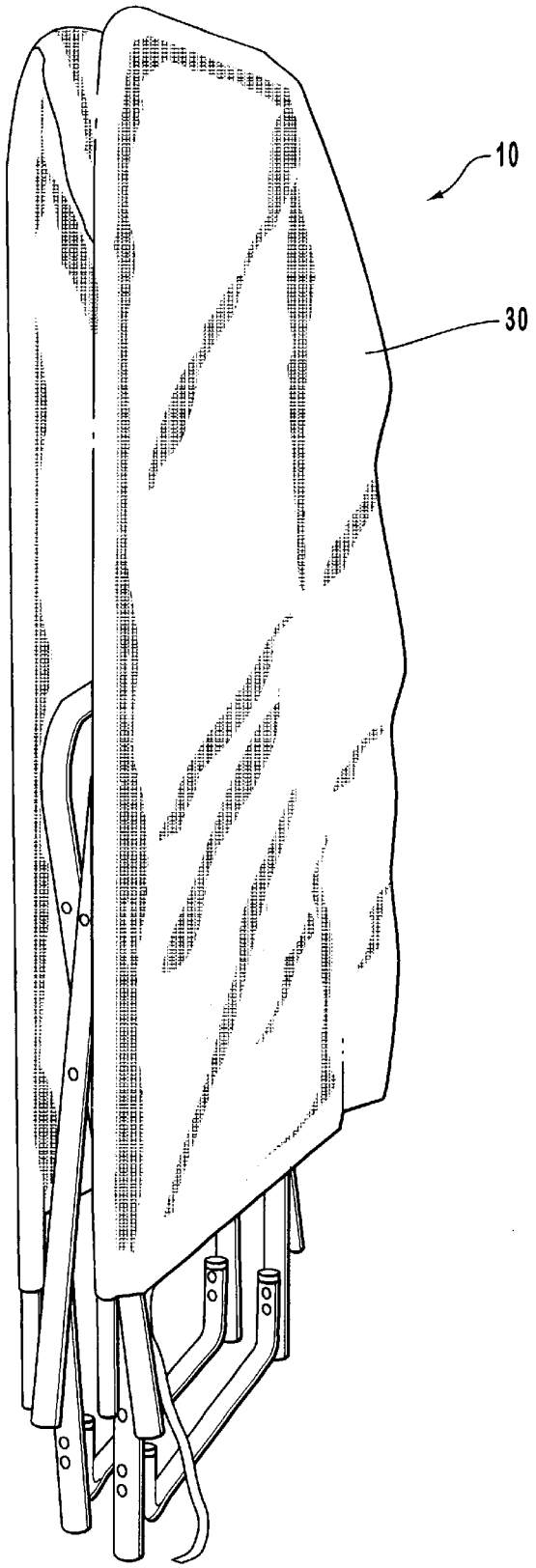
FIG. 2 is a perspective view of the lightweight collapsible enclosure of FIG. 1, but in its collapsed state.

Advantages of the present invention over the prior art is not only its lightweight characteristic, but its readily collapsible nature. As shown in FIG. 2, without impeding the folding of the folding chair, the enclosure readily collapses with the folding chair. This permits a user to change locations or directions within seconds without the burden of the tear down and set up of known shelters. A good example is ice fishing. When a tent shelter is erected over a hole in the ice, moving to a new location requires excessive time and work. With the present invention, the fisherman stands up, collapses the chair and enclosure, walks to a new location, unfolds the chair and enclosure and sits down again. This permits sheltered fishing and mobility not heretofore known. The same is true for game hunters who like to move to different locations. Using the present invention as a hunting blind, the hunter is able to easily transport his blind with him to virtually any desired location. Furthermore, if there arises an urgent, immediate need or desire to move or change direction of sight, transport and mobility is only seconds away.

Furthermore, the enclosure can be left inserted into or connected to the folding chair. In this way, without requiring the carrying of any more than a lightweight folding chair, the user can have the benefits of an encircling enclosure or enclosure to suit the needs of the user. The present invention, unlike the prior art, has no moving parts, is easy to manufacture, construct, and is erected in the mere seconds that it takes to unfold a collapsed folding chair.

It is also contemplated that a shoulder strap or carrying sling could be attached to either the enclosure or the chair to effect hands-free transporting of the enclosure.

In the foregoing specification, the invention has been described as reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A collapsible enclosure for a collapsible folding chair with a seat and sides comprising:

one or more rigid support members having a portion adapted to be readily inserted into or attached to the folding chair, the one or more of the rigid support members defining a vertical and lateral span about and above the folding chair;

a canopy disposed about the one or more rigid support members to define a multi-sided enclosure about and above the folding chair, the canopy defining one or more openings through which the one or more rigid support members may pass the one or more of the openings defining the positional relationship of the canopy to the one or more rigid support members, and the one or more rigid support members remaining rigid and unfolded while inserted into or attached to the folding chair yet permitting the canopy to be readily foldable and freely collapsible when the sides of the folding chair are collapsed toward each other.

2. The collapsible enclosure of claim 1, wherein the openings in the canopy are eyelets or sleeves through which the one or more of the rigid support members may pass.

3. The collapsible enclosure of claim 1, wherein the one or more of the rigid support members are of lightweight construction.

4. The collapsible enclosure of claim 3, wherein the support members are of tubular construction.

5. The invention of claim 1, further comprising means for releasably attaching the one or more rigid support members to the folding chair.

* * * * *